United States Patent [19]

Hatfield

[11] Patent Number: 5,059,091

[45] Date of Patent: Oct. 22, 1991

[54] GAS TURBINE ENGINE COMPRESSOR ASSEMBLY

[75] Inventor: John E. Hatfield, Warwick, England

[73] Assignee: Rolls-Royce plc, London, England

[21] Appl. No.: 534,947

[22] Filed: Jun. 8, 1990

[30] Foreign Application Priority Data

Jul. 21, 1989 [GB] United Kingdom ..... 8916658

[51] Int. Cl.[5] ..... F01B 25/00

[52] U.S. Cl. ..... 415/11; 415/58.2; 415/126; 415/148

[58] Field of Search ..... 415/148, 150, 47, 48, 415/49, 11, 13, 52.1, 58.2, 58.4, 126, 127

[56] References Cited

U.S. PATENT DOCUMENTS

| | | | |
|---|---|---|---|
| 3,365,120 | 1/1968 | Jassniker | 415/126 |
| 3,504,986 | 4/1970 | Jackson | 415/49 |
| 4,257,733 | 3/1981 | Bandukwalla et al. | 415/150 |
| 4,517,803 | 5/1985 | Jamison . | |
| 4,527,949 | 7/1985 | Kirtland | 415/150 |
| 4,616,483 | 10/1986 | Leonard | 415/47 |
| 4,743,161 | 5/1988 | Fisher et al. | 415/58.4 |
| 4,802,817 | 2/1989 | Tyler | 415/49 |
| 4,932,835 | 6/1990 | Sorokes | 415/150 |

FOREIGN PATENT DOCUMENTS

| | | | |
|---|---|---|---|
| 0198784 | 10/1986 | European Pat. Off. . | |
| 0011405 | 1/1977 | Japan | 415/59 |
| 0122907 | 10/1978 | Japan | 415/148 |
| 0133613 | 10/1979 | Japan | 415/148 |
| 1190092 | 11/1985 | U.S.S.R. | 415/148 |
| 1366715 | 1/1988 | U.S.S.R. | 415/58.4 |
| 305214 | 1/1929 | United Kingdom . | |
| 1195993 | 6/1970 | United Kingdom . | |
| 2007300 | 5/1979 | United Kingdom . | |
| 2052635 | 1/1981 | United Kingdom . | |
| 2211246 | 6/1989 | United Kingdom . | |

*Primary Examiner*—Edward K. Look
*Assistant Examiner*—Christopher M. Verdier
*Attorney, Agent, or Firm*—Oliff & Berridge

[57] ABSTRACT

A compressor assembly (12,13) for a gas turbine engine (10) comprises a centrifugal compressor (12) having a variable cross-sectional area diffuser (13) located at its downstream end. When the cross-sectional area of the diffuser (13) is less than a maximum value, some of the air exhausted from the downstream end (24) of the compressor (12) is directed to the upstream end (23) thereof. Sufficient air is so directed as to ensure that the mean air velocity at the outlet (30) of the diffuser (13) remains substantially constant.

9 Claims, 3 Drawing Sheets

GAS TURBINE ENGINE COMPRESSOR ASSEMBLY

BACKGROUND OF THE INVENTION

This invention relates to a gas turbine engine compressor assembly.

It is well known in the field of gas turbine engines to utilise a device known as a diffuser in order to reduce the velocity of a fluid flow exhausted from a compressor and thereby provide a corresponding increase in its pressure. Diffusers are located at the compressor outlet and typically consist of a duct which progressively increases in cross-sectional area in the direction of fluid flow or alternatively fixed vanes which define passages of progressively increasing cross-sectional area. The present invention is relevant to gas turbine engine compressor assemblies which incorporate either of these types of diffuser.

The diffuser of a gas turbine engine compressor assembly is usually designed so that it is most efficient in its operation when the gas turbine engine in which it is situated is operating under full power or near full power conditions. If the gas turbine engine is called upon to operate at lower levels of power, the efficiency of the diffuser falls and so in turn does the efficiency of the gas turbine engine. Ideally the velocity of the fluid flow exhausting from the diffuser should remain the same irrespective of whether the gas turbine engine is operating at full power or at lower levels of power. This can be achieved by mechanically varying the cross-sectional area of the diffuser. However difficulties associated with the mixing of the fluid flow through the diffuser can occur and in turn lead to local velocity variations in the fluid flow exhausted from the diffuser. Such local velocity variations are looked upon as being highly undesirable in view of the efficiency losses which they bring about in the operation of the gas turbine engine.

SUMMARY OF THE INVENTION

It is an object of the present invention to provide a gas turbine engine compressor assembly incorporating a diffuser in which improved efficiency is achieved under part full load conditions.

According to the present invention, a compressor assembly suitable for a gas turbine engine comprises a fluid flow compressor having upstream and downstream ends with respect to the flow in operation of a fluid therethrough, and a diffuser located at the downstream end of said compressor, means being provided to vary the cross-sectional flow area of said diffuser at least at a given location within said diffuser, from a maximum value to a minimum value, to maintain in operation the mean fluid flow velocity at the outlet of said diffuser at a substantially constant level, means being provided to direct a proportion of fluid exhausted from the downstream end of said compressor to the upstream end thereof to be recirculated through said compressor, at least when the cross-sectional area at said given location within said diffuser is less than said maximum value, the amount of said fluid so recirculated being directly proportional to said diffuser cross-sectional flow area at said given location.

BRIEF DESCRIPTION OF THE DRAWINGS

The invention will now be described, by way of example, with reference to the accompanying drawings in which.

DESCRIPTION OF THE PREFERRED EMBODIMENT

Figure 1:
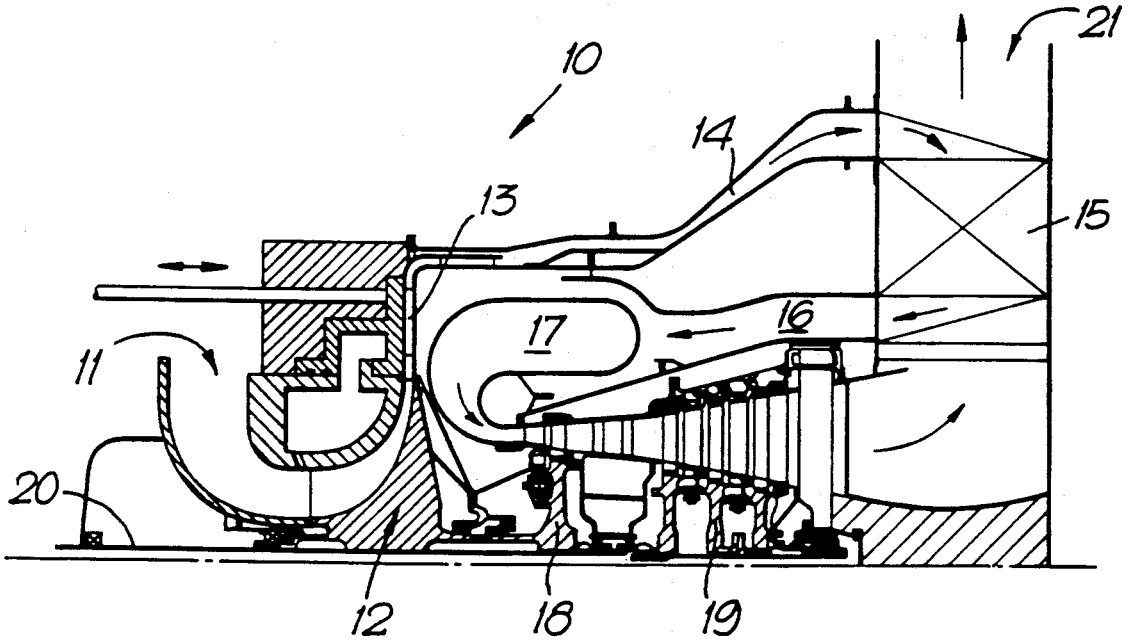
FIG. 1 is a sectioned side view of the upper half of a gas turbine engine which incorporates a compressor assembly in accordance with the present invention.

With reference to FIG. 1, a gas turbine engine generally indicated at 10 comprises a radial flow air intake 11 which directs air to a centrifugal compressor 12. Air compressed by the centrifugal compressor 12 is directed through a diffuser 13 where its velocity is reduced and pressure increased. From the diffuser 13 the air passes through a duct 14 and into a heat exchanger 15 where its temperature is raised by being placed in heat exchange relationship with the hot exhaust efflux from the engine 10.

The heated air from the heat exchanger 15 is directed through a further duct 16 to an annular reverse flow combustion chamber 17. There the air is mixed with fuel and the mixture combusted. The resultant hot combustion products then expand through a first axial flow turbine 18, which drives the compressor 12 and a second turbine 19, which is a power turbine driving a power output shaft 20. The power output shaft 20 extends through the appropriate apertures provided in the compressor 12 and first turbine 18 to emerge at the upstream end of the engine 10.

The hot combustion products exhausted from the power turbine 19 are directed radially outwards through the heat exchanger 15 where, as previously described, they are placed in heat exchange relationship with the air flow from the diffuser 13. The now cooled combustion products are finally exhausted to atmosphere through a radial exhaust outlet 21.

The present invention is particularly concerned with the compressor assembly of the engine 10, that is the assembly comprising the centrifugal compressor 12 and the diffuser 13 located downstream of it. The construction of the compressor assembly can be seen more easily if reference is now made to FIG. 2.

Figure 2:
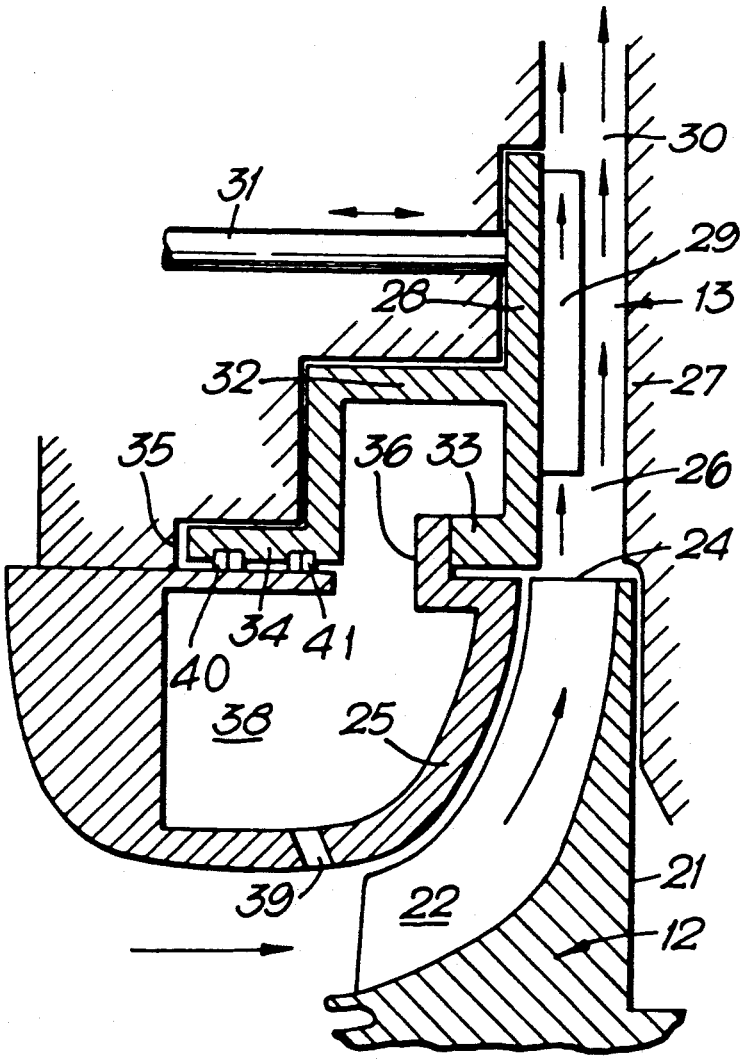
FIG. 2 is a sectioned side view, on an enlarged scale, of the compressor assembly of the gas turbine engine shown in FIG. 1 operating in a first mode of operation.

Referring to FIG. 2, the centrifugal compressor 12 comprises a rotor 21 of conventional configuration which carries a plurality of vanes 22, one of which can be seen in FIG. 2. Thus in operation, air enters the centrifugal compressor 12 in an axial direction at its upstream end 23 and is exhausted in a radial direction from its downstream end 24. A casing 25 surrounds the outermost edges of the vanes 22 to ensure that air leakage past those edges is minimised.

Air exhausted from the downstream end 24 of the centrifugal compressor 12 is directed into the diffuser 13, which, as previously stated, serves to reduce the velocity of the air and increase its pressure. The diffuser 13 comprises an annular, radially disposed chamber 26, one wall 27 of which is fixed and the other of which 28 is axially translatable with respect to the longitudinal axis of the engine 10.

The axially translatable wall 28 carries a plurality of diffuser vanes 29, one of which can be seen in FIG. 2. The diffuser vanes 29, which extend only part way across the gap between the walls 27 and 28, cooperate to define generally radially extending channels. The diffuser vanes 29 are configured in the conventional manner so that adjacent vanes 29 define channels (not shown) which are divergent in a generally radially outward direction so as to achieve the necessary degree of diffusion of the air flow.

The diffuser 13 is so arranged that under full power or near full power conditions of the gas turbine engine 10, the air exhausted from it at its outlet 30 is at the optimum pressure and velocity for efficient engine operation. If, however, the gas turbine engine 10 is required to operate at less than full power or near full power, the centrifugal compressor 12 will slow down and thereby deliver less air to the diffuser 13. This in turn leads to a reduction in the mean velocity and pressure of the air exhausted from the diffuser. Since a reduction in the mean velocity of the air exhausted from the diffuser outlet 30 is undesirable from the point of view of overall engine efficiency, steps are taken to ensure that the mean velocity of the air exhausted from the diffuser outlet is increased to the same level that it is when the engine 10 is operating under full power or near full power conditions. This is achieved by the axial translation of the diffuser wall 28 towards the diffuser wall 27 so as to reduce the cross-sectional flow area of the diffuser 13 and results in the constriction of the diffuser 13, thereby providing a speeding up of the air passing through it.

Although in the present embodiment of the present invention, the whole of one wall 28 of the diffuser is translated so as to achieve the necessary degree of constriction, it may under certain circumstances be possible to translate only a part or parts of the wall 28.

The fact that the diffuser vanes 29 only extend part way across the gap between the walls 27 and 28 facilitates the variation of that gap. This fact also means that the diffuser 13 is not as effective as one in which the vanes 29 extend across the whole of the gap between the walls 27 and 28. Tests have however indicated that an acceptable degree of diffusion can be achieved with such vanes.

The wall 28 is translated by means of an annular array of actuating rods 31, only one of which can be seen in FIG. 2. The actuating rods are powered hydraulically, although other means could be employed in accordance with the throttle setting of the engine. Thus as the engine throttle is opened and closed, the wall 28 translates correspondingly towards and away from the wall 27.

The wall 28 carries two flanged pieces 32 and 33. The first flanged piece 32 is provided with a further flange 34 of smaller diameter which locates in a correspondingly shaped recess 35 provided in a static part of the compressor assembly. The recess 35 and flange 34 cooperate to define a guide which assists in the efficient and translation of the movable wall 28. Bearings 40, 41, only two being shown in FIGS. 2 and 3, between casing 25 and further flange 34 facilitate the smooth movement of translatable wall 28.

Figure 3:
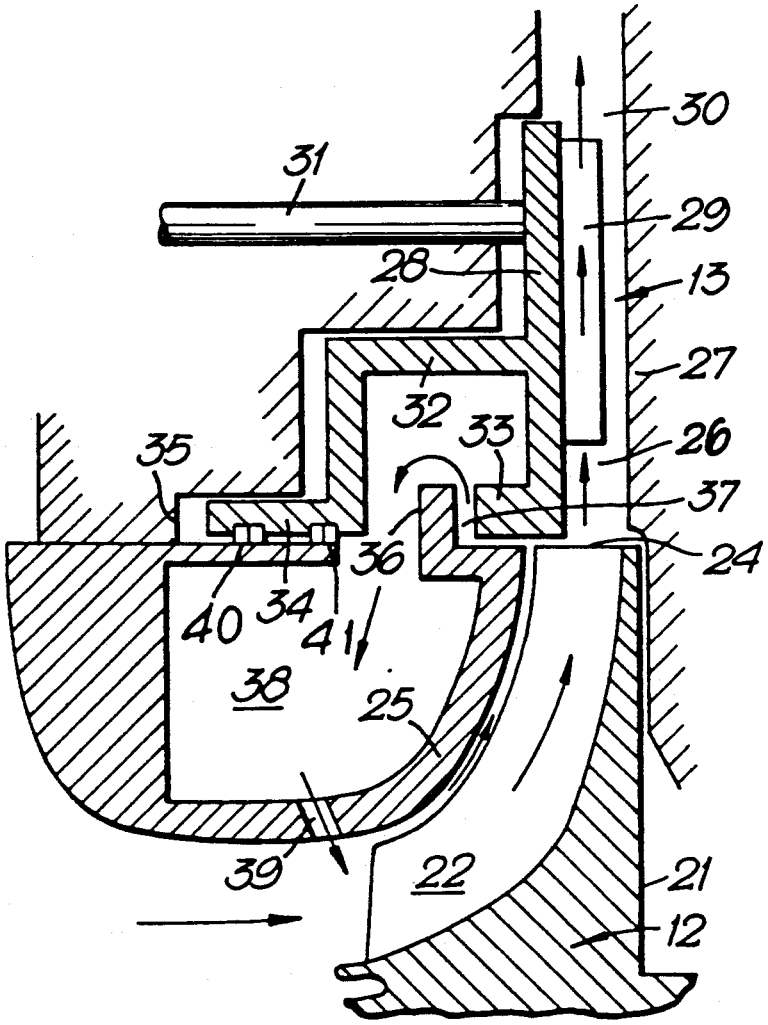
FIG. 3 is a view of the compressor assembly shown in FIG. 2 operating in a second mode of operation.

The second flanged piece 33 abuts a rim 36 provided on the downstream end of the casing so that together they define a substantially gas tight seal. However as the diffuser wall 28 is translated axially towards the other diffuser wall 27, a gap 37 opens up between the further flanged piece 33 and the rim 36 as can be seen in FIG. 3. The second flanged piece 33 and the rim 36 thus function as a valve. Some of the air exhausted from the downstream end of the compressor 12 flows through the gap 37 and into an annular chamber 38 which is defined by the casing 25, the flanged pieces 32 and 33 and part of the translatable wall 28. A series of apertures 39 are provided in the casing 25 adjacent the upstream end 23 of the compressor 12. Thus when the gap 37 is opened by the axial translation of the diffuser wall 28, some of the air exhausted from the downstream end 24 of the compressor 12 is recirculated back to the upstream end 23 thereof via the chamber 38. This of course has the effect of reducing the amount of air which is subsequently directed into the diffuser 13 from the centrifugal compressor 12. It also has the effect of heating up that air which is recirculated so that some of the air delivered to the upstream end 23 of the compressor 12 is of higher temperature than the remainder. The overall temperature of the air passing through the compressor 12 thereby increases which in turn brings about a reduction in the output power of the engine 10. However since the gap 37 is only open when a reduction in engine output power is required this is looked upon as a desirable effect.

The reduction in air flow through the diffuser 13 resulting from the opening up of the gap 37 brings about an advantageous effect upon the air flow which exhausted from the diffuser outlet 30. Thus under part full power conditions when the cross-sectional area of the diffuser 13 is reduced, there can as previously stated be considerable variation in the air velocity at different locations in the diffuser outlets. This is caused to a large extent by air turbulence and mixing associated with the vanes 29 which results from the changes in air flow conditions within the diffuser 13 brought about by the reduction in its cross-sectional area. The reduction in air flow through the diffuser 13 as a result of recirculating air through the compressor 12 reduces this turbulence and mixing, thereby bringing about smaller air flow velocity variation in the air flow exhausted from the downstream end 30 of the diffuser and in turn ensuring more efficient engine operation.

It will be seen therefore that the features of diffuser cross-sectional area reduction and air flow recirculation through the compressor 12 act in concert with each other to ensure that under part full power conditions, the gas turbine engine 10 continues to function in an efficient manner.

It will be noted that the apertures 39 through which air is bled from the chamber 38 to the upstream end 23 of the compressor 12 are inclined towards the compressor upstream end 23. This to a certain extent has the same effect as positioning inlet guide vanes upstream of the compressor 12. Consequently under part full power conditions, the performance advantage of inlet guide vanes is achieved without actually having them present, thereby bringing about weight savings.

I claim:

1. A compressor assembly suitable for a gas turbine engine comprising a fluid flow compressor having upstream and downstream ends with respect to a fluid flow through said fluid flow compressor during operation, and a diffuser located at the downstream end of said compressor, means being provided to vary a cross-sectional flow area of said diffuser, at least at a given location within said diffuser, from a maximum value to a minimum value, to maintain, in operation, a mean fluid flow velocity at the outlet of said diffuser at a substantially constant level, means being provided to direct a proportion of fluid exhausted from the downstream end of said compressor to the upstream end thereof to be recirculated through said compressor, at least when the cross-sectional area at said given location within said diffuser is less than said maximum value, the amount of said fluid so recirculated being directly proportional to said diffuser cross-sectional flow area at said given location.

2. A compressor assembly as claimed in claim 1 wherein said diffuser includes a plurality of vanes.

3. A compressor assembly as claimed in claim 1 wherein said diffuser comprises a chamber which includes a translatable wall member, said wall member being translatable across a direction of operational fluid flow through said diffuser to vary the cross-sectional area of said diffuser at least at said given location.

4. A compressor assembly as claimed in claim 3 wherein said diffuser includes a plurality of vanes mounted upon said translatable wall member.

5. A compressor assembly as claimed in claim 3 wherein said wall member is translatable in accordance with a throttle setting of said gas turbine engine.

6. A compressor assembly as claimed in claim 3 wherein said means provided to direct a proportion of fluid exhaust from the downstream end of said compressor to the upstream end thereof includes valve means operable by said translatable wall member so that the amount of fluid permitted to flow through said valve means varies in accordance with the cross-sectional area of said diffuser at least at said given location as determined by a position of said translatable wall member in said diffuser.

7. A compressor assembly as claimed in claim 6 wherein said valve means is annular.

8. A compressor assembly as claimed in claim 1 wherein said means provided to direct a proportion of fluid exhausted from the downstream end of said compressor to the upstream end thereof is arranged to simulate the effect of inlet guide vanes whereby said fluid is exhausted into the fluid flow at the upstream end of said compressor.

9. A compressor assembly as claimed in claim 1 wherein said compressor is of a centrifugal type.

* * * * *